United States Patent [19]

Itaya et al.

[11] Patent Number: 4,664,505

[45] Date of Patent: May 12, 1987

[54] ELECTROSTATIC IMAGE REPRODUCING APPARATUS

[75] Inventors: Masahiko Itaya; Satoshi Haneda, both of Hachioji, Japan

[73] Assignee: Konishiroku Photo Industry Co., Ltd., Tokyo, Japan

[21] Appl. No.: 828,083

[22] Filed: Feb. 7, 1986

Related U.S. Application Data

[63] Continuation of Ser. No. 453,283, Dec. 27, 1982, abandoned.

[30] Foreign Application Priority Data

Dec. 28, 1981 [JP] Japan ..... 56-209826

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 4,140,389 | 2/1979 | Franke et al. | 355/15 |
| 4,252,435 | 2/1981 | Manghirmalani | 355/15 |
| 4,325,628 | 4/1982 | Torigai et al. | 355/15 |
| 4,361,396 | 11/1982 | Uchida | 355/15 |
| 4,376,578 | 3/1983 | Tanaka et al. | 355/15 |

*Primary Examiner*—Fred L. Braun

*Attorney, Agent, or Firm*—Jordan B. Bierman

[57] ABSTRACT

A cleaning device for removing residual toner from an image support member after transferring a developed image therefrom including a fur-brush moveable in contact with the image support, a toner separating projection for knocking toner free from the fur-brush, a cylindrical member having a toner receiving opening adjacent the fur-brush and a rotatable toner transporting member therein, and a magnetic field arranged from the outside of the cylindrical member, the toner transporting member preferably being in the form of a spiral wire rotated in contact with the inside wall of the cylindrical member for transporting toner collected thereon to a reservoir at one end.

4 Claims, 6 Drawing Figures

ELECTROSTATIC IMAGE REPRODUCING APPARATUS

This is a continuation of U.S. application Ser. No. 453,283 filed Dec. 27, 1982, now abandoned, which claims the priority of Japanese application No. 209826/81 filed Dec. 28, 1981.

BACKGROUND OF THE INVENTION

1. Field of the Invention

The present invention relates to a cleaning device in an image reproducing apparatus using magnetic toner and whereby toner remaining on an image pattern support may be removed, transported and recovered.

2. Description of the Prior Art

In such an electrophotographic copying apparatus and facsimile apparatus which are typified of an image reproducing apparatus, an image recording has been performed in such a manner that an electrostatic latent image of a document or an electric information is formed on a photosensitive receptor or a dielectric by applying a reflected light or an electric information signal which has been obtained by exposing and scanning the original document, said electrostatic latent image thus formed has been visualized by a development process, the visualized image has been then transferred onto a copy paper, and transferred image on the copy paper has thus been fixed.

FIG. 1 shows a schematic construction of a conventional type electrophotographic copying apparatus, wherein a lamp 2 irradiates light to a document G placed on original document table 1 which reciprocates in the direction of the arrow shown by the solid line, and the reflected light from the document G is projected onto a photosensitive receptor 3*a* of a rotatable drum 3 rotating in the direction of the arrow, and thus, an electrostatic latent image of the document G is formed on photosensitive receptor 3*a*. There are arranged around rotatable drum 3 with a charging electrode 4 for charging photosensitive receptor 3*a*, a developing device 5, a transferring electrode 6, a separating electrode 7, a charge eliminating electrode 8 and a cleaning device 9 of a fur brush type, one after another. The electrostatic latent image thus formed is visualized by developing device 5, and the visible image thus obtained is transferred by transferring electrode 6 onto a copy paper P having been fed from such a paper feeding device 10 such as a paper cassette by means of a transporting device 11. After transferring, copy paper P is separated from photosensitive receptor 3*a* by separating electrode 7 and is then transported to fixing device 13 by transporting device 12, and therein is fixed, and is thus ejected to copied paper ejecting tray 14.

In the abovementioned apparatus, and in order to use photosensitive receptor 3*a* repeatedly, it is required to eliminate a residual electric charge and toner which are still remaining on the surface of photosensitive receptor 3*a* after the transferring process in a series of the abovementioned electrophotographic processes, and to cope therewith, such the residual charge is eliminated by charge eliminating electrode 8 and such residual toner are removed by cleaning device 9, respectively.

As for the cleaning devices to be used in the image reproducing apparatuses of this kind, there have been known various ones such as those of the fur-brush type, blade type, magnetic brush type and the like. In a fur-brush type cleaning device, a fur-brush made of animal hairs such as rabbit fur or of synthetic fibers is continuously rotated to remove the toners remaining on the surface of a photosensitive receptor, and the toners adhered to the fur-brush are flicked off by a toner flicking plate that is the so-called a flicker-bar, and the toners thus flicked off are vacuum-absorbed or are absorbed by a fan to recover them through a filter. In a blade type one, a blade made of an elastic synthetic resin is brought into pressure contact with the surface of a photosensitive receptor to remove remaining toners. In a magnetic-brush type one, lastly, which is exclusively used with magnetic toners, a non-magnetic cylindrical sleeve is provided closely to the surface of a photosensitive receptor so that magnets of which poles are opposite each other are alternately arranged respectively inside the sleeve, and the sleeve is rotated with carriers being adsorbed thereon or the magnets are rotated, to adsorb the remaining toners on the surface of the photosensitive receptor and then to remove the remaining toners, and thus, the toners are scraped off by a blade or the like from the surface of the sleeve to recover the toners.

In recent years, with the advance of the copying apparatuses in which the copying speeds are being increased and the moving speed of the photosensitive receptors are accelerated, a blade type cleaning device cannot sometimes afford to clean up toners satisfactorily, and therefore, fur-brush type ones have so far been utilized in high-speed copying apparatuses. Such a fur-brush type cleaning device is characterized in that it does not damage the surface of a selenium photosensitive receptor drum as a blade does, because the fur-brush does not press itself against the surface of the drum and does not have such a blade to which a solid matter may adhere, and therefore it is possible to extend the life-time of the photosensitive receptor. From the points of view mentioned above, a fur-brush type cleaning device has attracted special attention recently.

FIG. 2 shows a schematic construction of a magnetic-brush type cleaning device having so far been used. Wherein, reference numeral 9 indicates a cleaning device in which there are arranged inside housing 91 with fur-brush unit 92, magnetically toner recovery-unit 93 and scraping-off blade 94 among those of which said fur-brush unit 92 is provided so as to rotate coming into contact with photosensitive receptor 3*a*, said magnetically toner recovery unit 93 and said blade 94 are provided closely to the fur-brush unit 92 respectively. Fur-brush unit 92 comprises that implanted brush-fiber 92*b* made of animal hairs or synthetic fibers in on the circumferential surface of brush-core 92*a* and, on the other hand, the tip of protrusion 91*a* formed inside housing 91 is extended to the position where the tip gets in touch with brush-fiber 92*b*. Magnetic recovery-unit 93 is so designed that, magnet-roll 93*b* formed by arranging alternately the poles being opposite to each other inside non-magnetic cylindrical sleeve 93*a*, the magnet-roll 93*b* is so arranged as to keep a very narrow gap from the internal surface of cylindrical sleeve 93*a* which is rotatable in the direction of the arrow. Scraping-off blade 94 is so provided as to come closely into contact with the surface of cylindrical sleeve 93*a*.

Now, in the abovementioned cleaning device, when fur-brush 92 and cylindrical sleeve 93*a* are rotated respectively in the direction of the arrow, magnetic toners T remaining on photosensitive receptor 3*a* are electrostatically attracted by the frictional charge of brush-fiber 92*b* to remove from photosensitive receptor 3*a*.

The magnetic toners adhered to brush-fiber 92*b* are knocked off by protrusion 91*a* of housing 91 and are then attracted and transported onto cylindrical sleeve 93*a* by the magnetic attraction force of magnet-roll 93*b*. Toners on cylindrical sleeve 93*a* are scraped off by scraping-off blade 94 to be stored in reservoir 91*e* provided in a portion of housing 91.

However, if scraping-off blade 94 is increased in its contact capability with cylindrical sleeve 93*a* in order to improve the toner recovery, the adjustment of such contact capability would relatively be difficult because the loads would be increased to cylindrical sleeve 93*a* and at the same time the toners are also given stresses. In the case of utilizing toners thus scraped off, an additional means for transporting toners to a development device is required. Besides the above, the fur-brush type cleaning devices would be unsuitable for recovering toners unless some countermeasure could be taken to prevent the toners from mixing in with the brush-fiber chips of a fur-brush having been worn out for a long time usage, though it could probably be suitable if some measure also could be taken. There might further cause such a problem that the inside of the housing is apt to be contaminated with toners being blown up smogwise when the fur-brush and the cylindrical sleeve are rotated at high speed.

SUMMARY OF THE INVENTION

The present invention has been achieved in consideration of the abovementioned points, and above problems can be attained to an electrostatic image reproducing apparatus for forming a reproduced image from an electrostatic latent image which is formed on an image support by developing magnetic toner and transferring said reproduced image, which comprises a cleaning device from removing a residual toner on the image support after transferring consisting essentially of a fur-brush providing on the image support so as to contact with the image support, a toner separating means for setting free toner adhered to the fur brush from said fur brush, a cylindrical member having a rotatable spiral member being laid open to a toner separating position of said fur brush and being brought into close contact with the inside wall of said cylindrical member, and a magnetic field generating means arranging outside said cylindrical member.

DETAILED DESCRIPTION OF THE PREFERRED EMBODIMENTS

Figure 1:
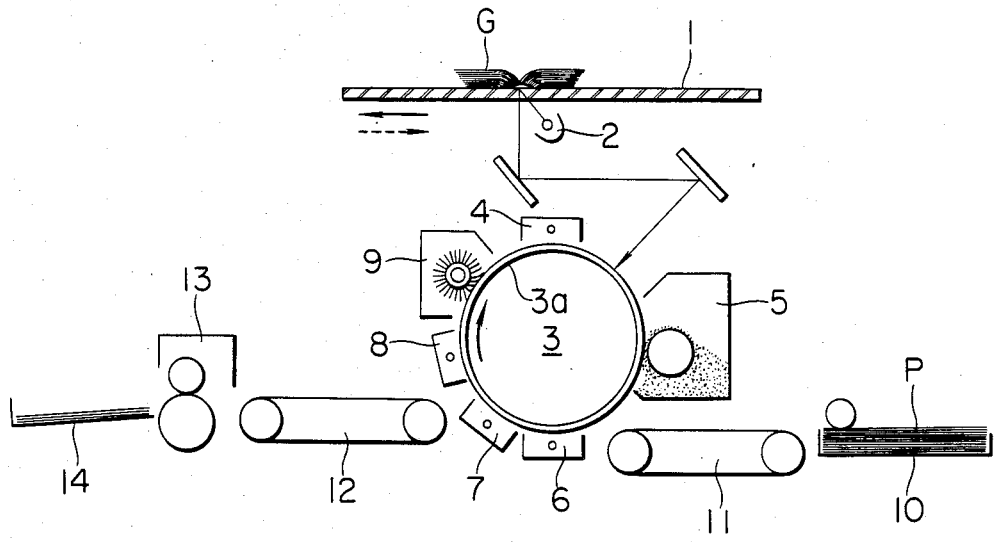
FIG. 1 PRIOR ART
FIG. 1 shows a schematic constitutional view of an electrophotographic copying apparatus.
Figure 2:
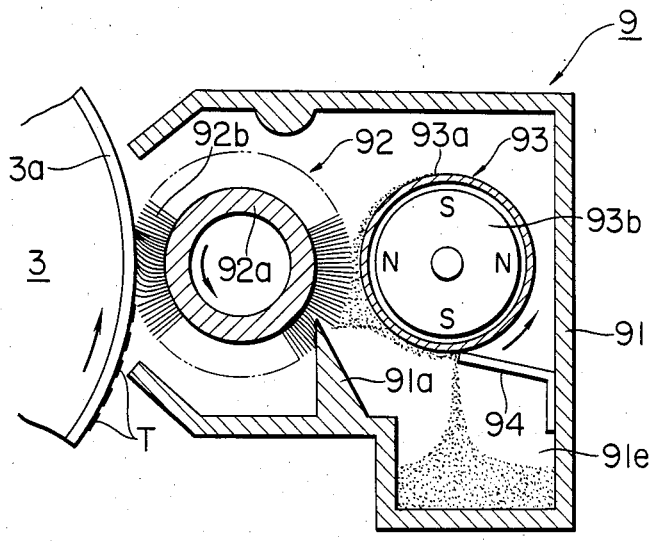
FIG. 2 PRIOR ART
FIG. 2 shows a schematic constitutional view of a conventional type cleaning device.
Figure 3:
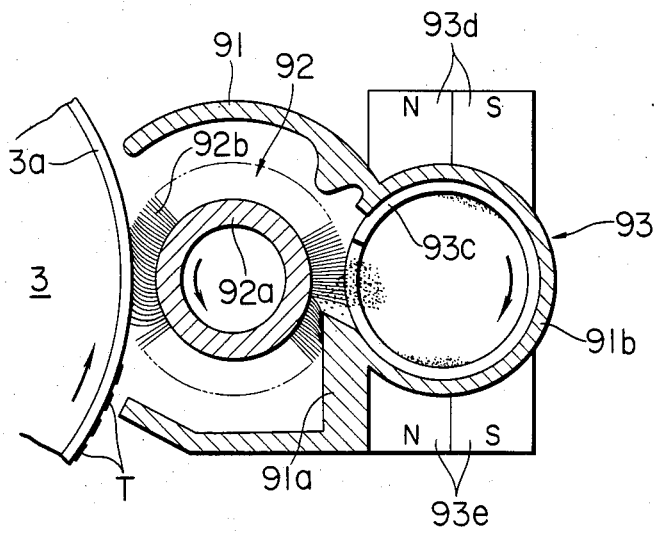
FIG. 3 shows a schematic constitutional view of an example of a cleaning device of the present invention.

FIG. 3 illustrates a schematic construction of an example of the cleaning device embodied by the present invention, wherein the reference numerals which are the same in FIG. 2 indicate identical components to those in FIG. 2. The different point of the example from the conventional embodiment shown in FIG. 2 is the constitution of the magnetic toner recovery unit. To be more concrete, the magnetic toner recovery unit 93 comprises a rear portion 91*b* of housing 91, coil 93*c* and magnetic field generating devices 93*d*, 93*e*, the rear portion 91*b* of housing 91 is made in the cylindrical shape, the coil 93*c* is made of a piano-wire distributed along the inner surface of the cylindrical portion 91*b* so as to be rotatable in the direction of the arrow, and the magnetic field generating devices having respectively an N-pole and an S-pole upward and downward are arranged outisde the cylindrical portion 91*b*. In this particular example, there used, a selenium drum, for example, as photosensitive receptor 3*a*, a toner consisting of a carbon, 50 parts of magnetite and styrene-acryl resin as magnetic toner, Teflon (polytetrafluoroethylene) fiber of 5 mm in the bristle length ass brush-fiber 92*b* of fur-brush 92, 1200 Gauss for the magnetic field force of magnetic field generating devices 93*d*, 93*e*, piano-wire for coil 93*c*, an ABS (styrene-butadiene-acrylonitril copolymer) resin for housing 91, and fur-brush unit 92 and coil 93*a* are rotated at 300 rpm and 100 rpm, respectively.

Figure 4:
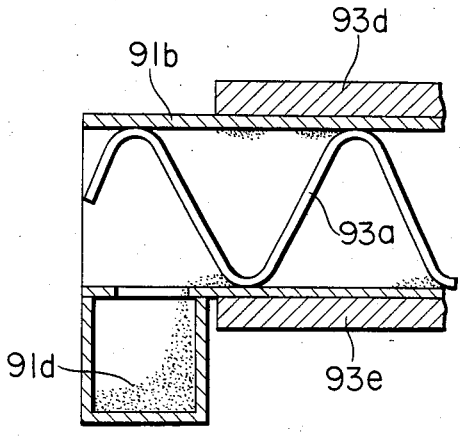
FIG. 4 is a cross-sectional view showing the end portion of the magnetic toner recovery unit in the exemplified cleaning device shown in FIG. 3.

Now, in the example, when fur-brush unit 92 and coil 93*c* are rotated, then toners T remaining on photosensitive receptor 3*a* are attracted electrostatically by brush fiber 92*b*. The toners thus adhered to brush fiber 92*b* are set free from brush fiber 92*b* by protrusion 91*a* of housing 91 and are then magnetically attracted by the magnetic intensity of magnetic field generating devices 93*d*, 93*e* toward the upper and lower sides of the inner wall of cylindrical portion 91*b*. The toners thus adhered to the inner wall of cylindrical portion 91*b* are transported in the direction of the axle as they are attracted to the inner wall by coil 93*c* which is rotating inside the cylindrical portion 91*b*. In this case, if magnetic field generating devices 93*d*, 93*e* are not extended in the axle direction over to one end of cylindrical portion 91*b* of housing 91 but are cut off at the end of cylindrical portion 91*b* as shown in FIG. 4 and toner reservoir 91*d* is provided at the very end, then the toners transported up to the very end of cylindrical portion 91*b* are dropped to the toner reservoir 91*d* and are accumulated therein.

Figure 5:
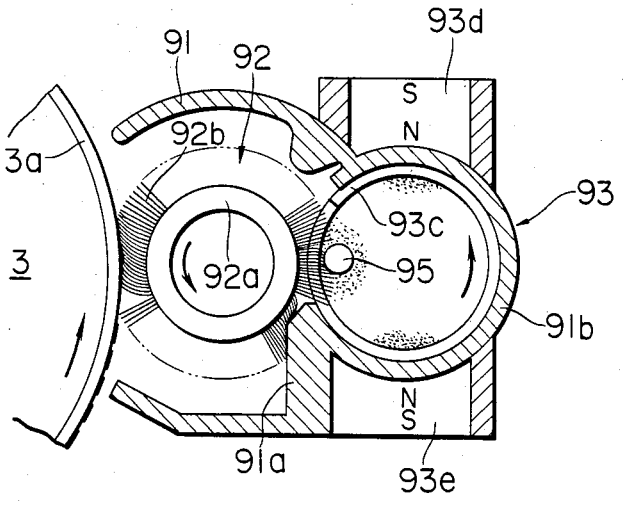
FIG. 5 is a partly perspective view showing a modified example of the magnetic toner recovery unit of the cleaning device of the present invention.

FIG. 5 shows a schematic construction of another example of cleaning device embodied by the present invention, wherein, coil 93*c* of magnetic toner recovery unit 93 is provided in position so as to make an inroad into brush fiber 92*b* of fur brush unit 92 and flipping member that is also so-called flicker-bar is provided in the position close to the coil 93*c* and coming into contact with brush fiber 92*b*.

Thus, brush fiber 92*b* of fur brush unit 92 and magnetic toner recovery unit 93 becomes closer to each other, therefore a strong magnetic attraction force is generated to recover the toners effectively.

In the case that there arranged the magnetic poles of magnetic field generating devices 93*d*, 93*e* so that the same poles (i.e., N-poles in the figure) of each device can be confronted each other with the interposition of cylindrical portion 91*b* of the housing as shown in the figure, toners will not bristle relatively higher when the toners are attracted by a repulsion magnetic field to the inner wall of cylindrical portion 91*b*, so that the toner transportability by means of coil 93*c* will be improved.

Figure 6:
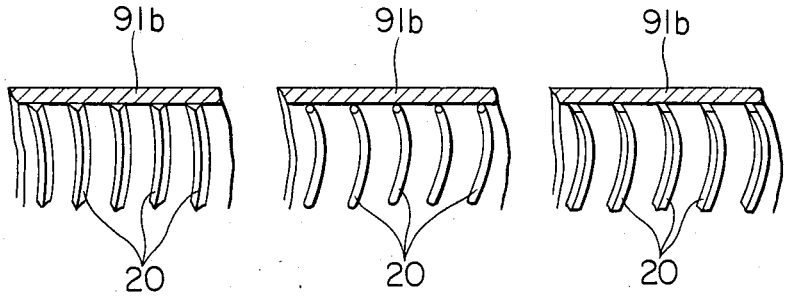
FIG. 6 is a schematic constitutional view showing the substantial portion of another example of the magnetic toner recovery unit in the cleaning devices of the present invention.

In the abovegiven example, a coil forming a toner transporting means shall not be limited to a piano-wire but may be a metal or a resin. It is also allowable as shown in FIG. 6 that cylindrical portion 91*b* is formed rotatably and separately from the housing and the protrusion 20 thereof is formed integratedly in spiral shape and then cylindrical portion 91*b* can be rotated.

As described above, in the present invention, a cylindrical-shaped hollow section is provided close to a fur-brush and a spiral-shaped toner transport member is rotatably provided so as to come into close contact with the inner wall of the hollow section, and at the same time magnetic field generating devices are provided to the outer side of the hollow section, and thus, the mechanism for transporting and recovering toners can be made compact in size and is capable of transporting the toners to anywhere desired and, in addition, the toners can be recycled easily. The invention is also suitable for the recycling of toners from the viewpoints that the scatter of toners caused in a recovery process can be reduced, toners are not applied with pressure in the recovery process, and toners are hardly cohered together.

What is claimed is:

1. In an electrostatic image reproducing apparatus for forming a reproduced image by developing an electrostatic latent image formed on an image support with magnetic toner and transferring said reproduced image, and having a cleaning device for removing residual toner on the image support after transferring, said cleaning device including a fur brush rotated in contact with the image support for removing toner therefrom and toner recovery means for recovering toner removed from said image support by said fur brush, the improvement wherein said toner recovery means comprises a cylindrical member having an opening elongated in the longitudinal direction of said cylindrical member and adjacent said fur brush, a toner transporting means rotatable within said cylindrical member consisting of a spiral member rotated in contact with an inside wall of said cylindrical member, and a magnetic field generating means arranged along the longitudinal outer surface of said cylindrical member, said toner recovery means being located in position so as to make contact with at least a part of said fur brush.

2. The apparatus of claim 1 wherein said magnetic field generating means effects magnetic attraction in the longitudinal direction of said cylindrical member up to a predetermined location.

3. The apparatus of claim 2 wherein said magnetic field generating means comprises a pair of south and north poles juxtaposed on the external surface of said cylindrical member.

4. The apparatus of claim 2 wherein said magnetic field generating means comprises identical poles arranged on the external surface of said cylindrical member.

* * * * *